US012617570B2

(12) United States Patent
Iwasa et al.

(10) Patent No.: US 12,617,570 B2
(45) Date of Patent: May 5, 2026

(54) FLAP FOLDING DEVICE, BOX MANUFACTURING DEVICE, BOX SEALING DEVICE, AND BOX PACKAGING DEVICE

(71) Applicant: ISHIDA CO., LTD., Kyoto (JP)

(72) Inventors: Tatsuya Iwasa, Ritto (JP); Yuji Yokota, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 19/037,136

(22) Filed: Jan. 25, 2025

(65) Prior Publication Data

US 2025/0250049 A1 Aug. 7, 2025

(30) Foreign Application Priority Data

Feb. 1, 2024 (JP) ..... 2024-014211

(51) Int. Cl.
*B65B 7/20* (2006.01)
*B65B 43/26* (2006.01)

(52) U.S. Cl.
CPC ..... *B65B 43/265* (2013.01); *B65B 7/20* (2013.01)

(58) Field of Classification Search
CPC ..... B65B 43/265; B65B 7/20
See application file for complete search history.

(56) References Cited

U.S. PATENT DOCUMENTS 1,832,262 A * 11/1931 Stimpson ..... B65B 51/026 53/376.5
1,893,496 A * 1/1933 Ferguson ..... B65B 7/20 53/387.2
3,546,839 A * 12/1970 Comstock ..... B65B 7/26 53/378.3
3,673,764 A * 7/1972 Bell ..... B65B 7/20 53/284
3,775,937 A * 12/1973 Devan ..... B65B 51/067 53/136.4
3,879,922 A * 4/1975 Derderian ..... B65B 7/20 53/376.5
3,973,375 A * 8/1976 Loveland ..... B65B 7/20 53/377.3

(Continued)

FOREIGN PATENT DOCUMENTS

FR 2 827 259 A1 1/2003
JP 2019-147583 A 9/2019
JP 6952466 B2 10/2021

OTHER PUBLICATIONS

Oct. 6, 2025, Extended European Search Report is in European Patent Application No. 25152511.9.

*Primary Examiner* — Lucas E. A. Palmer
(74) *Attorney, Agent, or Firm* — United IP Counselors, LLC

(57) ABSTRACT

A flap folding device includes a first member that folds a pair of first flaps toward an inside of an opening of a cardboard box, a second member that folds a pair of second flaps toward the inside of the opening, and a holding member including a rod-shaped or plate-shaped elongated portion extending along a long side direction of the opening, and pressing and holding the pair of folded first flaps by the elongated portion. The second member folds the pair of second flaps in a state where the pair of first flaps are held by the holding member after the first member folds the pair of first flaps. The holding member is attached to be swingable.

9 Claims, 10 Drawing Sheets

(56) References Cited

U.S. PATENT DOCUMENTS 3,981,122 A * 9/1976 Johnson ..... B65B 51/023 118/DIG. 3
4,213,285 A * 7/1980 Mancini ..... B65B 43/285 493/78
4,218,862 A * 8/1980 Marchetti ..... B65B 7/20 53/377.2
4,422,282 A * 12/1983 Marchetti ..... B65B 7/20 493/183
4,642,966 A * 2/1987 Marchetti ..... B65B 7/20 493/183
4,713,928 A * 12/1987 Tisma ..... B65B 7/20 53/526
4,722,165 A * 2/1988 Marchetti ..... B65B 43/52 53/76
4,807,428 A * 2/1989 Boisseau ..... B65B 5/024 53/247
4,955,177 A * 9/1990 Lerner ..... B65B 7/20 493/183
4,972,654 A * 11/1990 Marchetti ..... B65B 7/20 53/76
5,063,726 A * 11/1991 Boisseau ..... B31B 50/626 53/376.5
5,352,178 A * 10/1994 Pazdernik ..... B65B 43/39 493/137
5,417,032 A * 5/1995 Calvert ..... B65B 7/20 53/376.4
5,588,279 A * 12/1996 Runnberg ..... B29C 66/43122 53/484
5,839,254 A * 11/1998 Chen ..... B65B 7/20 53/136.4
5,916,106 A * 6/1999 Chen ..... B65B 51/067 53/378.3
6,070,396 A * 6/2000 Rinaldi ..... B65B 7/20 493/23
6,926,652 B2 * 8/2005 Marchetti ..... B65B 7/20 493/70
7,140,165 B2 * 11/2006 Ventura ..... B65B 59/003 493/476
7,278,248 B2 * 10/2007 Vinh Le ..... B65B 59/02 53/136.3
7,886,503 B2 * 2/2011 Chase ..... B65B 7/20 53/376.4
10,597,179 B2 * 3/2020 Menta ..... B65B 57/04
11,220,080 B2 * 1/2022 Iwasa ..... B31B 50/004
11,292,624 B1 * 4/2022 Frederick ..... B65B 5/106
2004/0093829 A1 * 5/2004 Marchetti ..... B65B 7/20 53/378.3
2004/0123559 A1 * 7/2004 Le ..... B65B 51/067 53/136.4
2004/0226268 A1 * 11/2004 Vinh Le ..... B65B 59/02 53/76
2010/0173765 A1 * 7/2010 Iwasa ..... B31B 50/00 493/183
2011/0197551 A1 * 8/2011 Book ..... B65B 51/144 53/484
2012/0317932 A1 * 12/2012 Dunivan ..... B65B 51/00 53/491
2015/0087491 A1 * 3/2015 Langen ..... B65B 43/305 493/162
2015/0375880 A1 * 12/2015 Ford ..... B65B 11/105 53/147
2019/0263545 A1 * 8/2019 Yokota ..... B31B 50/064
2021/0101354 A1 * 4/2021 Iwasa ..... B31B 50/003
2025/0100731 A1 * 3/2025 Matsui ..... B65B 57/16

* cited by examiner

FLAP FOLDING DEVICE, BOX MANUFACTURING DEVICE, BOX SEALING DEVICE, AND BOX PACKAGING DEVICE

TECHNICAL FIELD

The present disclosure relates to a flap folding device, a box manufacturing device, a box sealing device, and a box packaging device.

BACKGROUND

A flap folding device that folds a pair of first flaps provided on a short side of an opening of a spread cardboard sheet and a pair of second flaps provided on a long side of the opening to form a lid of a cardboard box is known (for example, refer to Japanese Patent No. 6952466). This flap folding device includes a holding member (pressing member) that presses and holds the pair of folded first flaps.

SUMMARY

In the above-described flap folding device, for example, when a position of the holding member or the second flap deviates, the holding member and the second flap may come into strong contact with each other, thereby causing a possibility of a problem in that the second flap is bent or the like.

In the present disclosure, a flap folding device, a box manufacturing device, a box sealing device, and a box packaging device which can avoid strong contact between a holding member and a second flap will be described.

(1) According to an aspect of the present disclosure, there is provided a flap folding device that folds a pair of first flaps provided on a short side of an opening of a spread cardboard sheet and a pair of second flaps provided on a long side of the opening to form a bottom or a lid of a cardboard box. The flap folding device includes a first member that folds the pair of first flaps toward an inside of the opening, a second member that folds the pair of second flaps toward the inside of the opening, and a holding member including a rod-shaped or plate-shaped elongated portion extending along a long side direction of the opening, and pressing and holding the pair of folded first flaps by the elongated portion. The second member folds the pair of second flaps in a state where the pair of first flaps are held by the holding member after the first member folds the pair of first flaps. The holding member is attached to be swingable.

In the flap folding device, even when a position of the holding member with respect to the second flap deviates and the holding member and the second flap come into contact with each other, the holding member swings. In this manner, it is possible to avoid strong contact between the holding member and the second flap.

(2) In the flap folding device according to (1), when the opening has a substantially square shape, the flap folded first may be the first flap, and the flap folded later may be the second flap. In this way, in the aspect of the present disclosure, even when the opening of the spread cardboard sheet has the substantially square shape, the present invention is applicable.

(3) In the flap folding device according to (1) or (2), the holding member may be configured to be swingable around an axis extending along the long side direction. In this case, the holding member can swing around the axis extending along the long side direction.

(4) In the flap folding device according to any one of (1) to (3), the holding member may partition a portion between the pair of second flaps folded by the second member such that the pair of second flaps do not overlap each other, in a state where the holding member presses and holds the pair of folded first flaps. In this case, the holding member can avoid overlapping between the pair of second flaps.

(5) In the flap folding device according to any one of (1) to (4), a portion of the first member may be provided integrally with the holding member. In this case, a device configuration can be simplified.

(6) In the flap folding device according to (3), the holding member may be swingable by at least 5° on each of one side and the other side in a rotation direction around the axis with respect to a reference position. In this case, the holding member can be effectively swung to avoid strong contact between the holding member and the second flap.

(7) According to another aspect of the present disclosure, there is provided a box manufacturing device including a spreading unit that grips a cardboard sheet in a folded state and spreads the cardboard sheet into a rectangular tubular shape, and the flap folding device according to any one of (1) to (6), which folds the pair of first flaps and the pair of second flaps of the cardboard sheet spread into the rectangular tubular shape by the spreading unit to form the bottom of the cardboard box. Even in the box manufacturing device, the flap folding device achieves an operational effect of avoiding strong contact between the holding member and the second flap.

(8) According to still another aspect of the present disclosure, there is provided a box sealing device including the flap folding device according to any one of (1) to (6), which folds the pair of first flaps and the pair of second flaps in the opening of the spread cardboard sheet having a bottom to form the lid of the cardboard box, and a tape attachment unit that attaches a tape to the lid to hold a state where the pair of second flaps is folded. Even in the box sealing device, the flap folding device also achieves the operational effect of avoiding the strong contact between the holding member and the second flap.

(9) According to still another aspect of the present disclosure, there is provided a box packaging device including the box manufacturing device according to (7), and a box packaging unit that accommodates an article in a cardboard box manufactured by the box manufacturing device. Even in the box packaging device, the flap folding device provided in the box manufacturing device also achieves the operational effect of avoiding the strong contact between the holding member and the second flap.

(10) According to still another aspect of the present disclosure, there is provided a box packaging device including the box sealing device according to (8), and a box packaging unit that accommodates an article in a cardboard box sealed by the box sealing device. Even in the box packaging device, the flap folding device provided in the box sealing device also achieves the operational effect of avoiding the strong contact between the holding member and the second flap.

According to the present disclosure, it is possible to avoid the strong contact between the holding member and the second flap.

DETAILED DESCRIPTION

Hereinafter, embodiments of the present disclosure will be described with reference to the drawings. In the following description, for convenience, each of front, rear, up, down, left, and right directions with respect to a box packaging device 1 is used. In some drawings, three-dimensional orthogonal axes indicating these directions are displayed. For example, a position where a box material (cardboard sheet) Z is placed and a position where a cardboard box B after sealing is discharged are front portions of the box packaging device 1. A position where product supply means 50 is provided is a rear portion of the box packaging device 1. Both a front-rear direction and a left-right direction are horizontally extending directions. An up-down direction is equal to a vertical direction.

Figure 1:
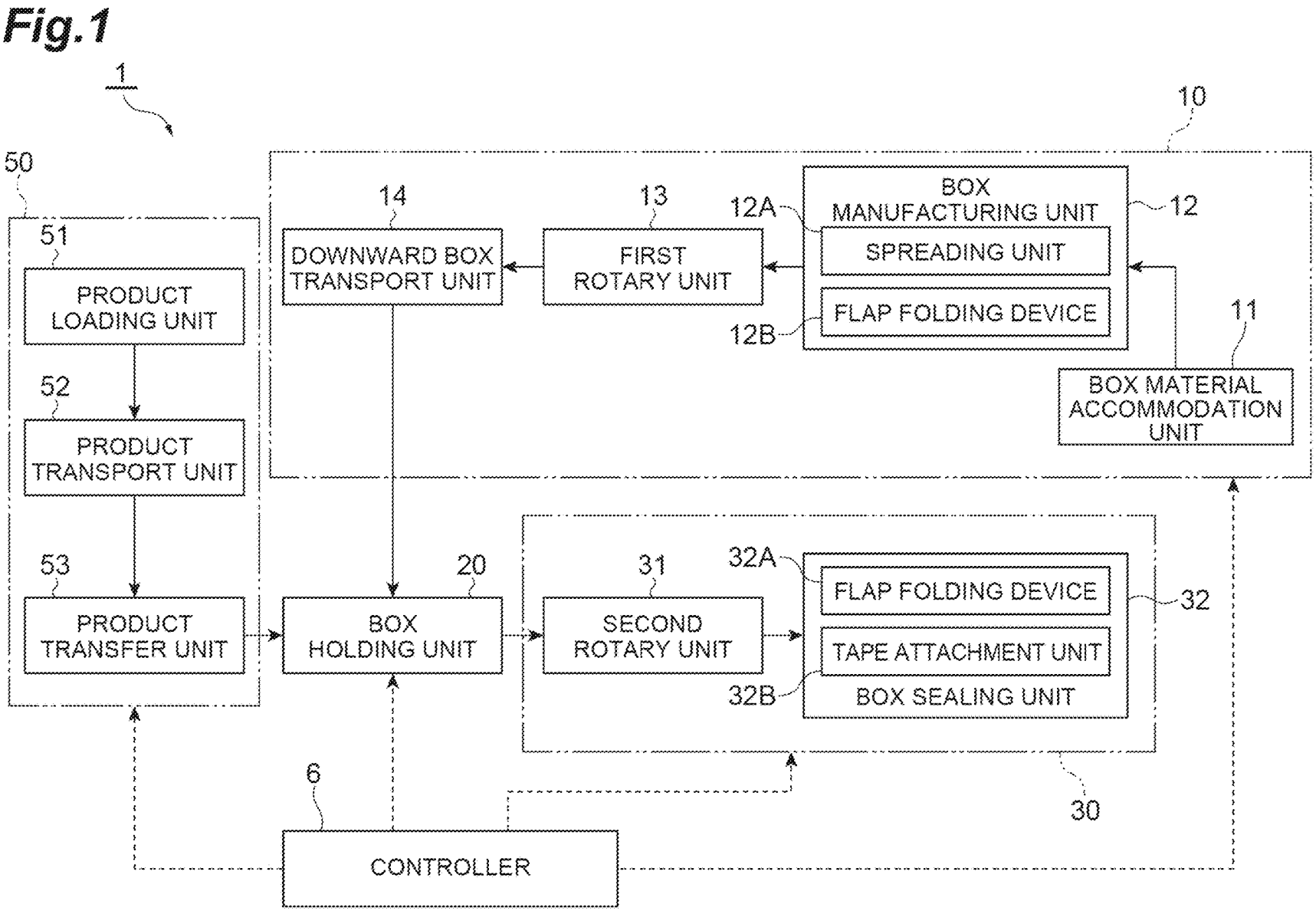
FIG. 1 is a block diagram of a box packaging device according to an embodiment.

First, an overall configuration of the box packaging device 1 of the present embodiment will be described with reference to FIGS. 1 and 2. As illustrated in FIG. 1, the box packaging device 1 is a device that assembles the cardboard box B (manufactures a box), accommodates a plurality of products (articles) A in the cardboard box B, and seals the cardboard box B. In the box packaging device 1, the plurality of box materials Z accommodated in a box material accommodation unit 11 are assembled one by one, and the plurality of products A sequentially loaded from an outside by the product supply means 50 are packaged in an aligned state in the cardboard box B.

A box main body Ba of the cardboard box B is a rectangular parallelepiped. That is, the box main body Ba includes four sides extending in the up-down direction, four sides being parallel to each other and having the same length, in a reference posture in which a top surface Bd faces upward. On the other hand, the box main body Ba has the top surface Bd and a bottom surface Bc, each of which has the same rectangular shape. The top surface Bd and the bottom surface Bc each include a pair of short sides C and a pair of long sides D. In a state where a flap Bf is open on the top surface Bd, the box main body Ba has an opening Bp. As in the top surface Bd, the opening Bp also includes the pair of short sides C and the pair of long sides D. (In a strict sense, there is a difference in a thickness of the box material Z between the top surface Bd and the opening Bp, but in the present embodiment, the top surface Bd and the opening Bp are not distinguished from each other in the thickness.)

Figure 2:
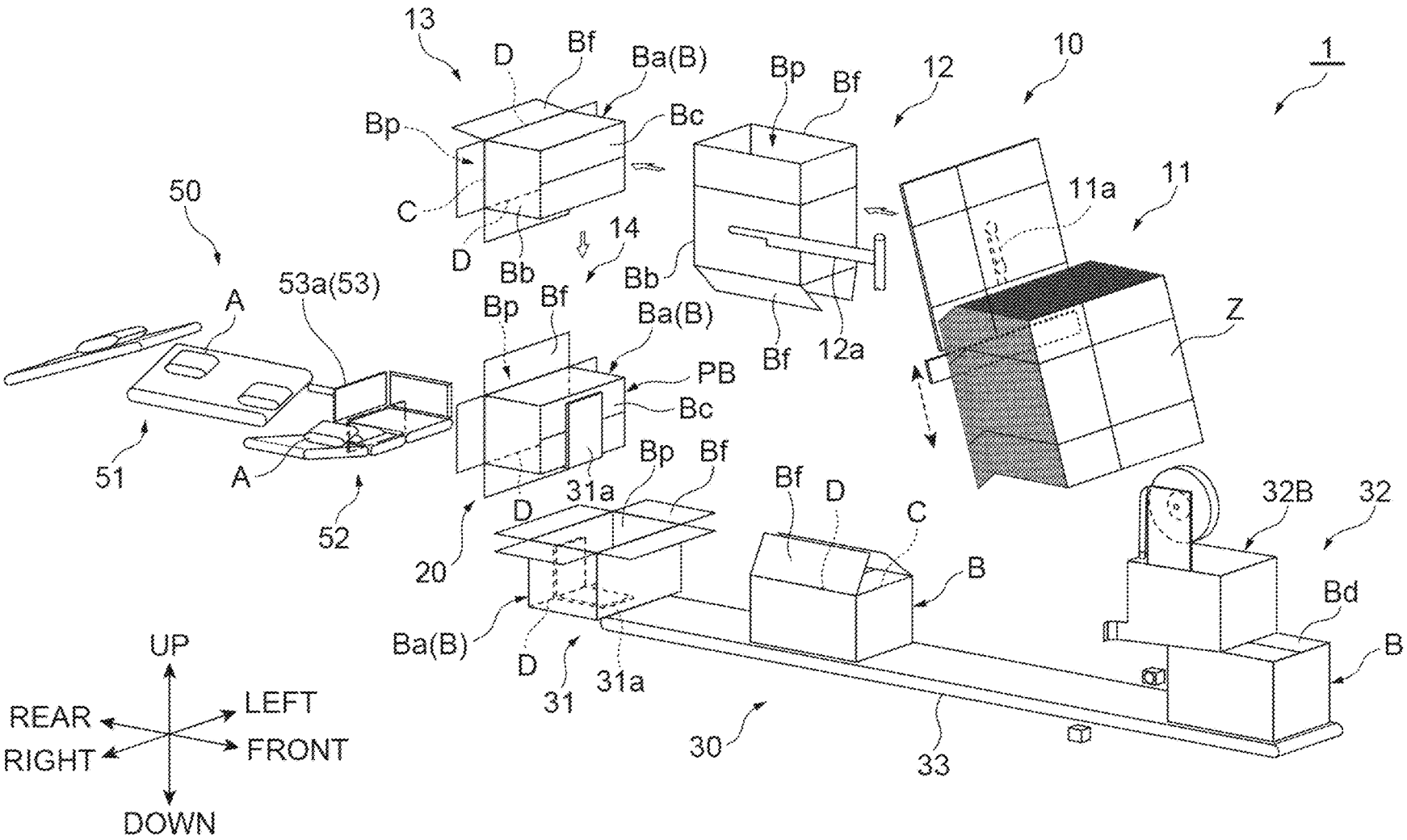
FIG. 2 is a perspective view illustrating a flow of a cardboard box and a product in the box packaging device in FIG. 1.

As illustrated in FIGS. 1 and 2, the box packaging device 1 includes box supply means 10 for assembling the cardboard box B and supplying the cardboard box B to a holding position PB, a box holding unit 20 that holds the cardboard box B at the holding position PB, and box sealing means 30 for transporting the cardboard box B accommodating the plurality of products A and sealing the cardboard box B. The box packaging device 1 further includes product supply means 50 for sequentially supplying the plurality of products A. Hereinafter, each configuration provided in the box packaging device 1 will be described.

The box supply means 10 includes a box material accommodation unit 11 that accommodates the plurality of box materials Z, a box manufacturing unit 12 that assembles the box main body Ba of the cardboard box B, a first rotary unit 13 that rotates the assembled box main body Ba, and a downward box transport unit 14 that transports the box main body Ba downward. The box material accommodation unit 11 supports the plurality of box materials Z superimposed and placed by a support portion (not illustrated). The box material accommodation unit 11 includes a raising and lowering mechanism 11*a* that takes out the box materials Z one by one. Each of the box materials Z taken out by the raising and lowering mechanism 11*a* is transported to a rear stage by a conveyor (not illustrated).

The box manufacturing unit 12 receives each of the box materials Z, spreads the box materials Z into a tubular shape, folds the flap Bf on a bottom surface side, and attaches a tape to the bottom surface Bc. In this manner, the box main body Ba is further transported rearward in a posture in which the opening Bp faces upward. In the present embodiment, the "manufacturing the box" of the cardboard box B means that the box main body Ba having a rectangular parallelepiped shape is formed. Therefore, the "manufacturing the box" does not necessarily require that the flap Bf on an upper surface side is folded. The box manufacturing unit 12 forms a box manufacturing device.

The box manufacturing unit 12 includes at least a spreading unit 12A and a flap folding device 12B. The spreading unit 12A grips the box material Z in a folded state, and spreads the box materials Z in a rectangular tubular shape. The flap folding device 12B folds the flap Bf of the box material Z spread in a rectangular tubular shape by the spreading unit 12A to form a bottom surface (bottom) Bc of the cardboard box B. Details of the flap folding device 12B will be described later. The box manufacturing unit 12 may include a suction rotation mechanism 12*a* that rotates the box main body Ba such that the long side D of the box main body Ba faces a transport direction.

The first rotary unit 13 rotates the cardboard box B after manufacturing the box in a predetermined posture. As an example, the first rotary unit 13 locates the long side D downward, and rotates the opening Bp in a laterally facing posture. For example, the posture of the cardboard box B rotated by the first rotary unit 13 is controlled by a controller 6 (to be described later).

The downward box transport unit 14 transports the box main body Ba downward. For example, the downward box transport unit 14 includes a pair of upper and lower transport belts that pinches the box main body Ba, and transports the box main body Ba downward by causing the pair of upper and lower transport belts to travel. The box holding unit 20 holds the cardboard box B at the holding position PB. For example, a portion (lower portion) of the downward box transport unit 14 forms the box holding unit 20 that holds the cardboard box B.

The product supply means 50 includes a product loading unit 51, a product transport unit 52, and a product transfer unit 53. For example, the product loading unit 51 is disposed on a downstream side of processes of inspecting a weight, sealing performance, foreign matter contamination, and the like, receives the supply of the product A qualified in the inspection, and delivers each of the products A to the product transport unit 52. The product transport unit 52 receives each of the products A adjusted to a predetermined posture from the product loading unit 51, erects the plurality of products A to form a product group X, and transports the product group X. The product transport unit 52 includes a plurality of conveyors, for example.

The product transfer unit 53 is transfer means for transferring the product group X into the box main body Ba (into the cardboard box B). The product transfer unit 53 has a transfer plate 53*a* including a plate-shaped portion facing a front surface and slidable in the front-rear direction. The transfer plate 53*a* is driven by the controller 6, and moves forward when the cardboard box B is completely held by the box holding unit 20 and the product group X is completely formed by the product transport unit 52. In this manner, the product group X is pushed (transferred) into the box main body Ba.

The box sealing means 30 includes a second rotary unit 31 that rotates the box main body Ba accommodating the product group X, a box sealing unit 32 that closes the box main body Ba with the flap Bf and attaches a tape, and a discharge conveyor 33 that transports the box main body Ba forward. The second rotary unit 31 includes a suction rotation mechanism 31*a* that rotates the box main body Ba by 90 degrees around an axis extending in the left-right direction. The second rotary unit 31 rotates the cardboard box B to be aligned with a transport direction of the cardboard box B in a direction in which the tape is attached by the box sealing unit 32. The box sealing unit 32 folds the flap Bf on a top surface side with respect to the box main body Ba transported by the discharge conveyor 33, and attaches the tape to the top surface Bd. The box sealing unit 32 forms a box sealing device. The box sealing unit 32 includes a flap folding device 32A and a tape attachment unit 32B.

The flap folding device 32A folds the flap Bf in the opening Bp of the box main body Ba (spread box material Z in which the bottom surface Bc is formed) on the discharge conveyor 33 to form the top surface (lid) Bd of the cardboard box B. Since the configuration of the flap folding device 32A is the same as the configuration of the flap folding device 12B of the box manufacturing unit 12, description thereof will be omitted. The tape attachment unit 32B attaches the tape to the top surface Bd to hold a state where the flap Bf is folded (state where the pair of second flaps is folded). A known mechanism can be adopted as the tape attachment unit 32B. The sealed cardboard box B is discharged from a front end portion of the box packaging device 1.

The box packaging device 1 includes the controller 6 that controls an operation of each portion of the box supply means 10, the box holding unit 20, the box sealing means 30, and the product supply means 50. The controller 6 is configured as a computer device including a processor such as a CPU, a memory such as a ROM and a RAM, a storage, a communication device, and the like. In the controller 6, the processor executes predetermined software (program) read into the memory or the like to control reading and writing of data in the memory and the storage and communication by the communication device. In this manner, various types of control are realized. In the above-described configuration, the product supply means 50 forms the box packaging unit that accommodates the product A in the cardboard box B manufactured by the box manufacturing unit 12, and the box packaging unit that accommodates the product A in the cardboard box B sealed by the box sealing unit 32.

Next, details of the flap folding device 12B will be described.

As illustrated in FIGS. 3, 4, 5, 7A, 7B, 9A, and 9B, the flap folding device 12B folds the pair of first flaps Bf1 and the pair of second flaps Bf2 of the spread box material Z to form the bottom surface Bc of the cardboard box B. The first flap Bf1 is the flap Bf provided on the short side C of the opening Bp of the spread box material Z, and the second flap Bf2 is the flap Bf provided on the long side D of the opening Bp of the spread box material Z. The first flap Bf1 is the flap Bf folded first, and the second flap Bf2 is the flap Bf folded later. The first flap Bf1 will also be referred to as a minor flap, and the second flap Bf2 will also be referred to as a major flap. The opening Bp has a substantially square shape. Hereinafter, the spread box material Z may also be referred to as the cardboard box B in some cases.

The flap folding device 12B includes a first member 60 and a first member 90 which fold the pair of first flaps Bf1 toward the inside of the opening Bp, a second member 70 that folds the pair of second flaps Bf2 toward the inside of the opening Bp, and a holding member 80 that presses and holds the pair of folded first flaps Bf1.

The first member 60 is a plate-shaped member extending in the horizontal direction and bent in a side view. In the illustrated example, the first member 60 extends along a horizontal surface in a rear end portion, and extends to be bent downward when viewed from a side surface as the first member 60 is directed from a rear end portion to a front side. The rear end portion of the first member 60 is provided at a height position corresponding to the first flap Bf1. In the first member 60, a surface 60*a* of the rear end portion is brought into contact with one first flap Bf1 to be pushed into the opening Bp, and the one first flap Bf1 is folded toward the inside of the opening Bp. The first member 90 is configured to include a movable arm (refer to FIG. 7B). The first member 90 drives the movable arm to come into contact with the other first flap Bf1 and to be pushed into the opening Bp, and the other first flap Bf1 is folded toward the inside of the opening Bp. The first member 90 is not particularly limited, and various known techniques may be adopted.

The second member 70 has a pair of contact portions 71. The contact portion 71 is a columnar rod member in which the front-rear direction is an axial direction. Each of the contact portions 71 is connected to an arm 72. Each of the contact portions 71 drives the arm 72 to come into contact with the second flap Bf2, is pushed into the opening Bp, and the second flap Bf2 is folded toward the inside of the opening Bp. The second member 70 will also be referred to as a second flap folding rod.

The holding member 80 includes an elongated portion 81 and a base portion 82. The elongated portion 81 presses and holds the pair of folded first flaps Bf1. The elongated portion 81 is a plate-shaped member extending along the front-rear direction (long side direction in which the long side D of the opening Bp extends). The elongated portion 81 is formed such that the left-right direction is set to the thickness direction and an upper portion thereof is thinner than the other portions (refer to FIG. 5). The first member 60 is fixed to and integrated with a front end side of the elongated portion 81. That is, the first member 60 is provided integrally with the holding member 80. The elongated portion 81 may be a rod-shaped member. The base portion 82 is a rectangular block-shaped member in which the front-rear direction is set to a longitudinal direction. The base portion 82 is provided in a lower portion of the elongated portion 81.

The flap folding device 12B includes a support portion 83, a shaft 84, and a restriction portion 85. The support portion 83 supports the holding member 80, the shaft 84, and the restriction portion 85. The support portion 83 includes at least plate-shaped vertical plates 83*x* and 83*y* in which the front-rear direction is set to the thickness direction, and a plate-shaped horizontal plate 83*z* in which the up-down direction is set to the thickness direction. For example, the support portion 83 is provided to be movable in the front-rear direction on an installation surface on which the flap folding device 12B is installed. In this manner, at least a portion of the flap folding device 12B is configured to be movable toward the box material Z.

The vertical plates 83*x* and 83*y* are disposed to pinch the base portion 82 in the front-rear direction. The shaft 84 in which the front-rear direction is set to the axial direction is coaxially provided in each of the vertical plates 83*x* and 83*y*. A rear end portion of the base portion 82 is attached to the shaft 84 of the vertical plate 83*x* via a bush, and a front end portion of the base portion 82 is attached to the shaft 84 of the vertical plate 83*y* via a bush. In this manner, the elongated portion 81 and the base portion 82 are supported to be swingable around the shaft 84 with respect to the vertical plates 83*x* and 83*y*. That is, the holding member 80 is attached to be swingable. The holding member 80 is configured to be swingable around the shaft 84 that is the axis extending along the front-rear direction. The horizontal plate 83*z* is disposed below the base portion 82 with a gap from the base portion 82.

Figure 3:
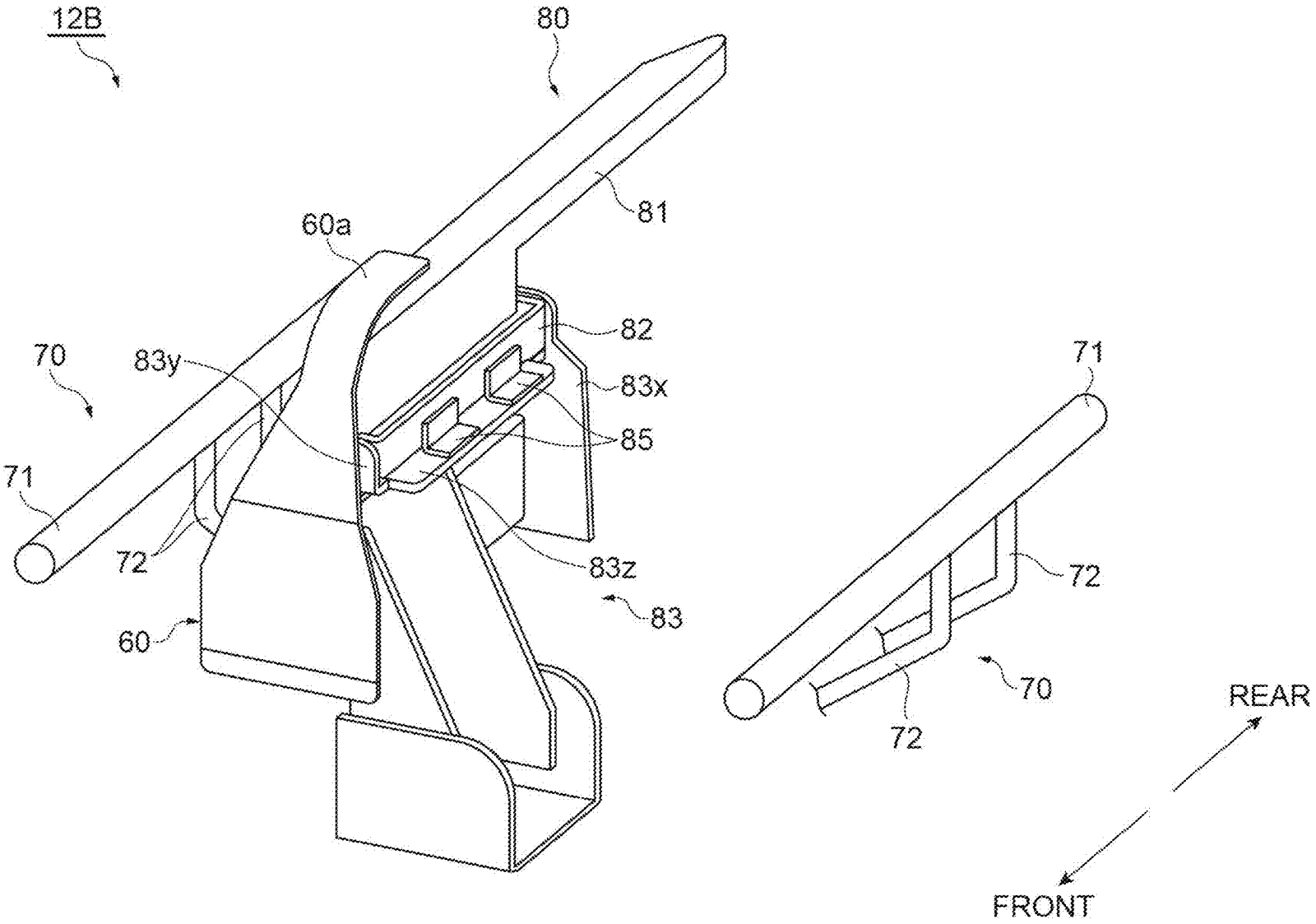
FIG. 3 is a perspective view illustrating a flap folding device in FIG. 1.
Figure 4:
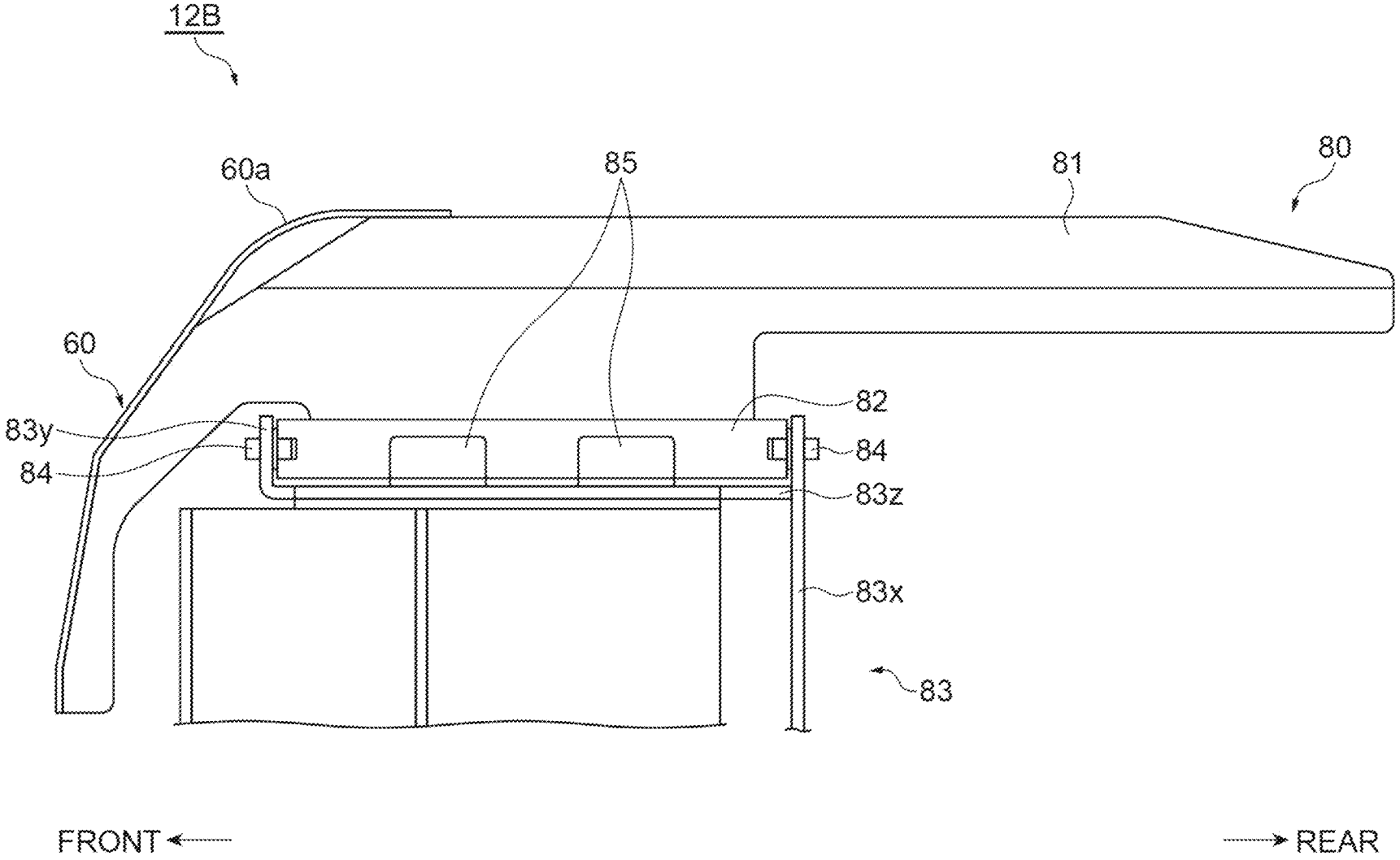
FIG. 4 is a side view illustrating the flap folding device in FIG. 3.
Figure 5:
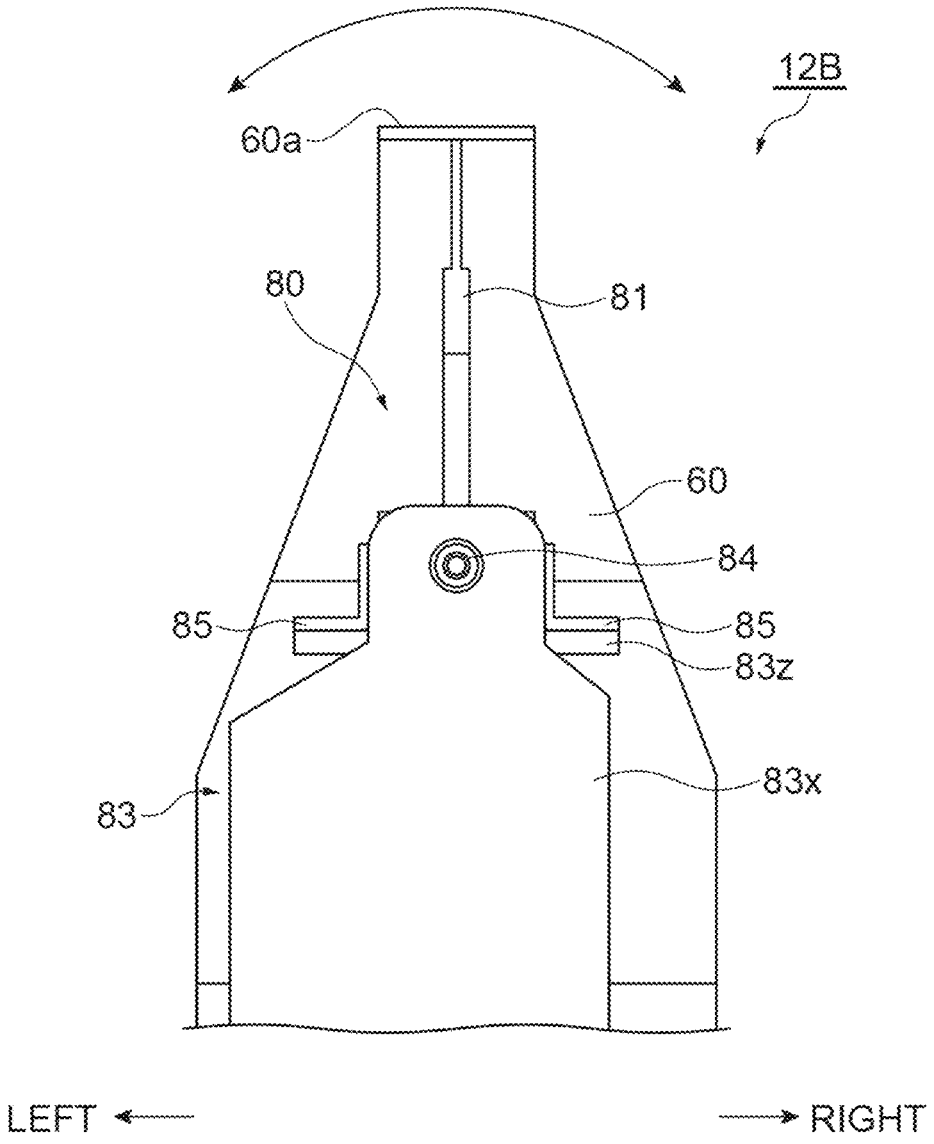
FIG. 5 is a rear view illustrating the flap folding device in FIG. 3.
Figure 6A:
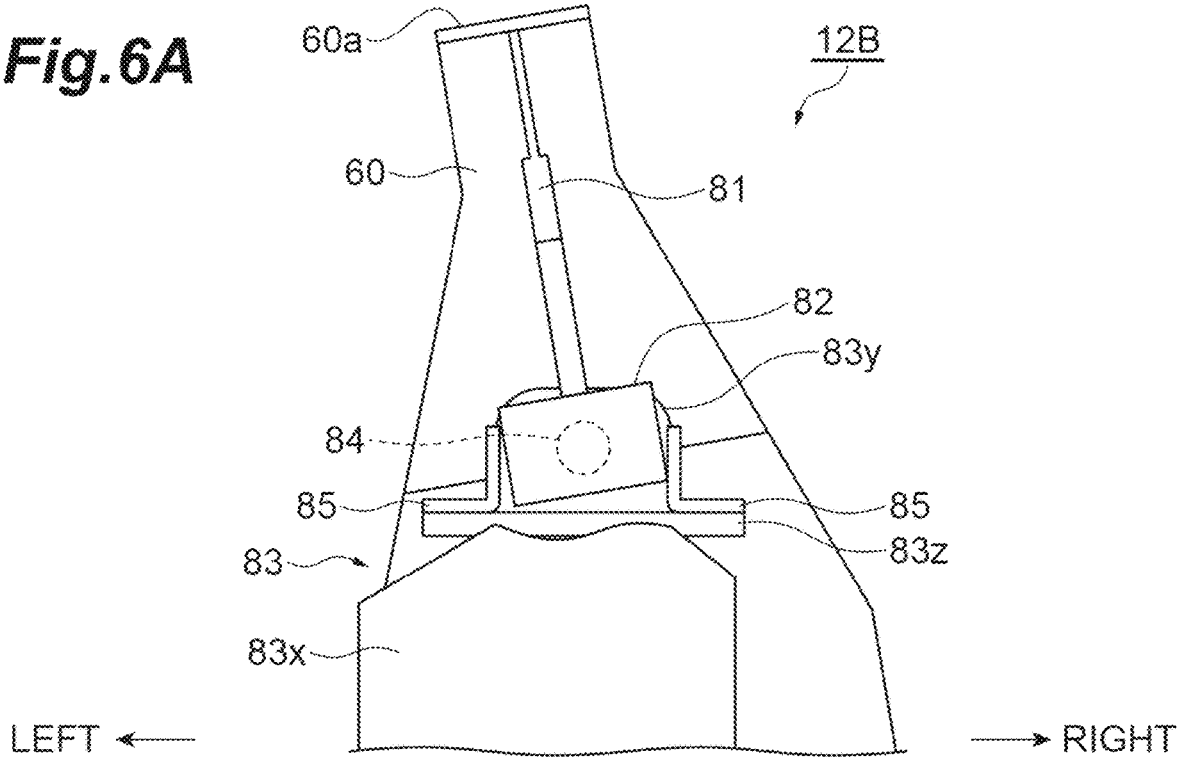
FIG. 6A is a rear view illustrating swinging of a holding unit in the flap folding device in FIG. 3.
Figure 6B:
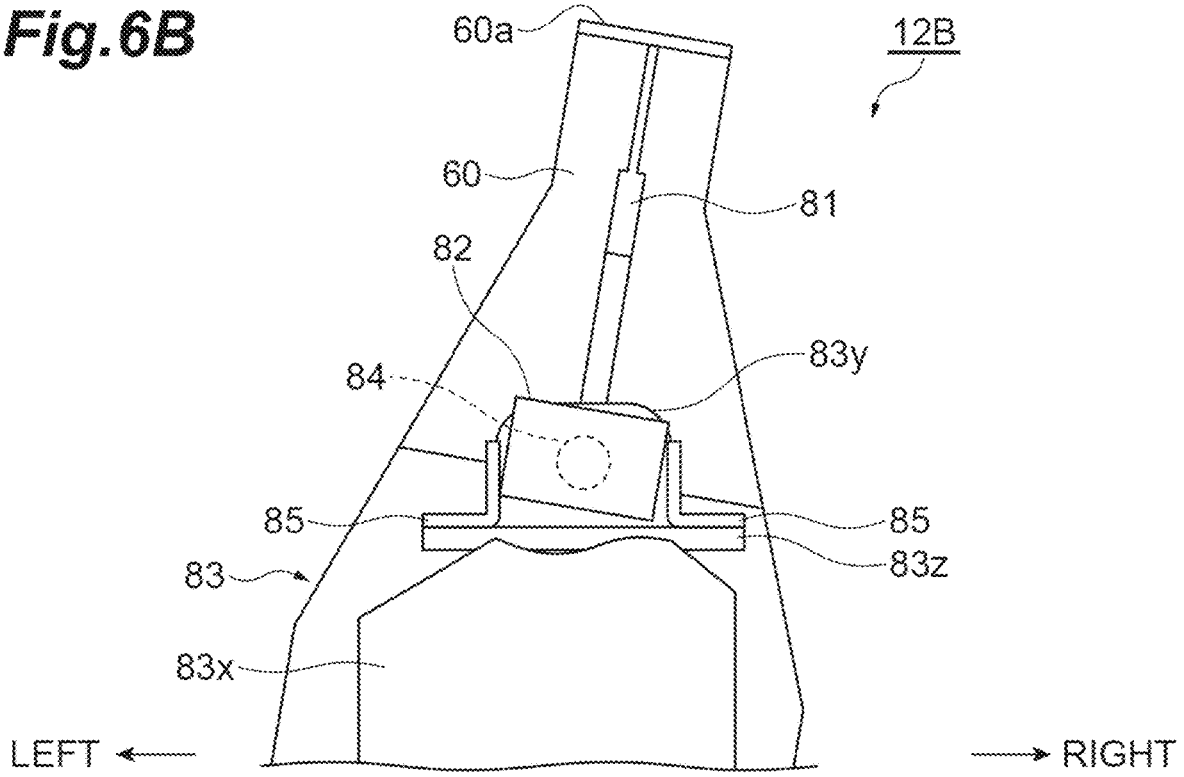
FIG. 6B is another rear view illustrating swinging of the holding unit in the flap folding device in FIG. 3.

As illustrated in FIGS. 3, 6A, and 6B, the restriction portion 85 is a member that restricts the swinging of the holding member 80. A plurality of the restriction portions 85 are respectively disposed on a right side and a left side of the base portion 82 on the horizontal plate 83*z*. The restriction portion 85 is a plate member bent in an L-shape, and includes a bottom plate extending along the horizontal surface and provided on the horizontal plate 83*z*, and a side plate extending upward from an end portion on the base portion 82 side in the bottom plate. The restriction portion 85 comes into contact with the swinging base portion 82 to restrict subsequent swinging of the holding member 80.

Specifically, the restriction portion 85 comes into contact with the base portion 82, and blocks subsequent swinging to one side in the rotation direction, when the holding member 80 swings around the shaft 84 by 5° from a reference position to one side in the rotation direction around the axis of the shaft 84 (hereinafter, also simply referred to as the "rotation direction") (refer to FIG. 6A). In addition, the restriction portion 85 comes into contact with the base portion 82, and blocks subsequent swinging to the other side in the rotation direction, when the holding member 80 swings around the shaft 84 by 5° from the reference position to the other side in the rotation direction. In this manner, the holding member 80 can swing at least 5° on each of one side and the other side in the rotation direction with respect to the reference position. The reference position is a position of the elongated portion 81 in a state of extending in the up-down direction. In FIGS. 6A and 6B, a portion of the vertical plate 83*x* is illustrated in a broken form.

Figure 7A:
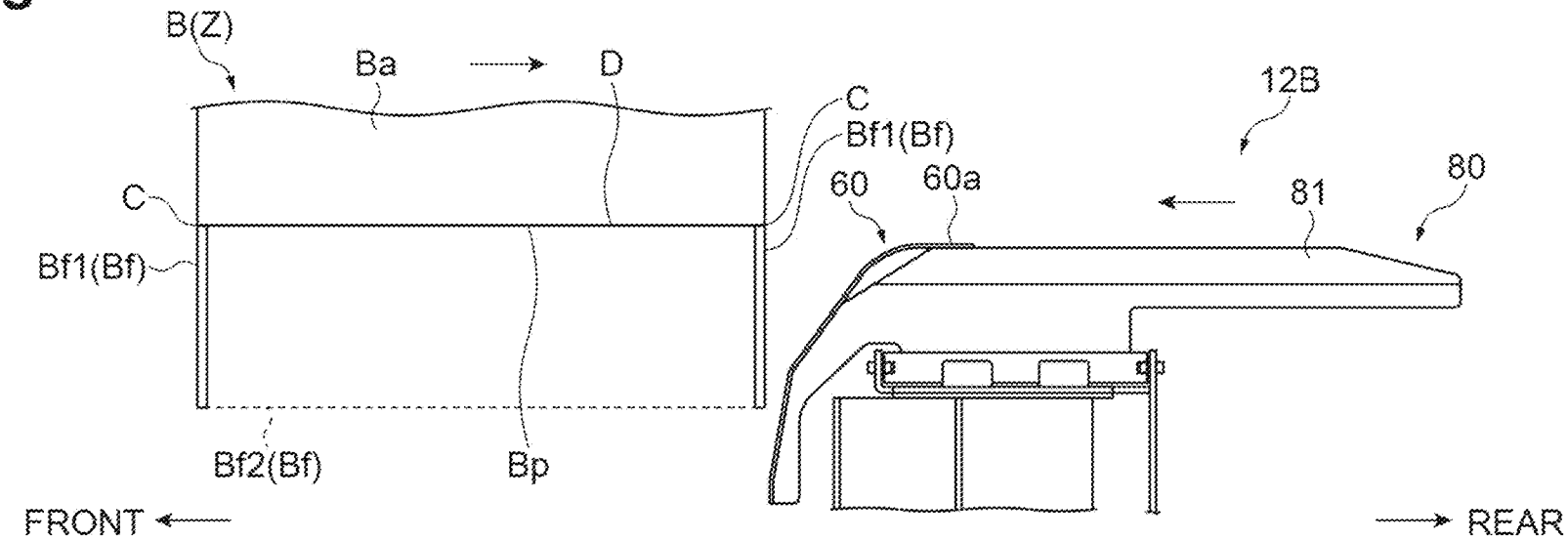
FIG. 7A is a side view illustrating an example of a case where a bottom surface of a cardboard box is formed by using the flap folding device in FIG. 3.
Figure 7B:
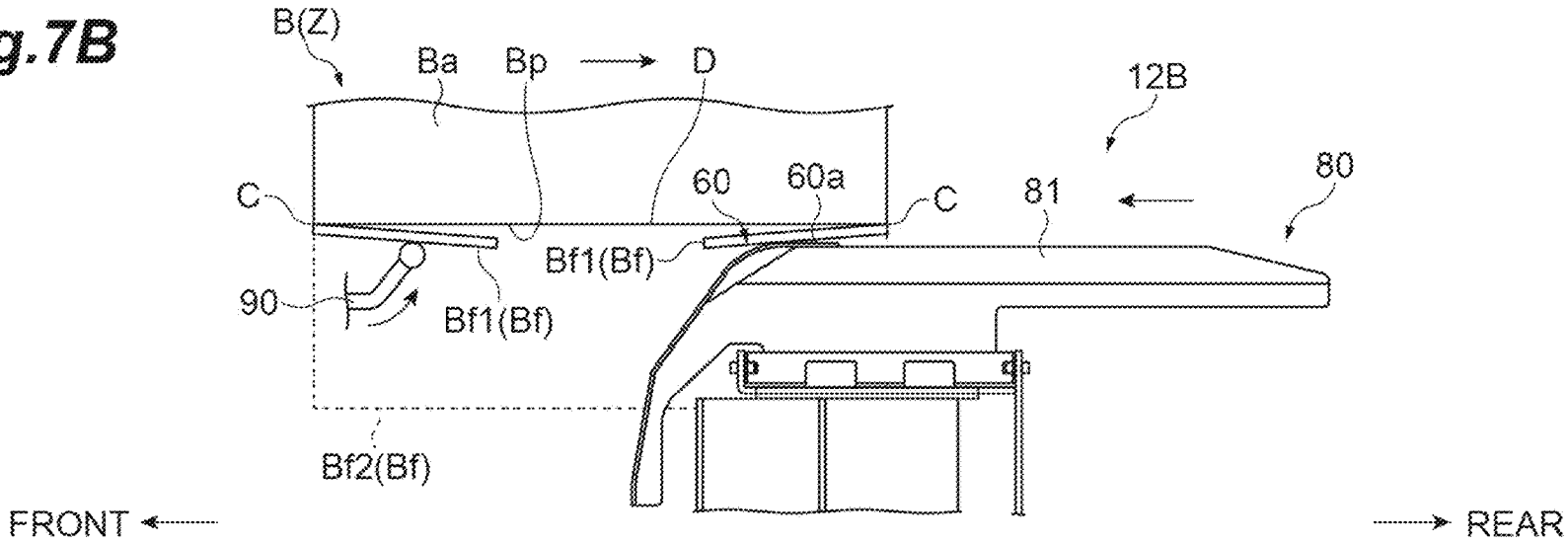
FIG. 7B is a side view subsequent to FIG. 7A.

When the bottom surface Bc of the cardboard box B is formed by using the flap folding device 12B described above, as illustrated in FIG. 7A, the flap folding device 12B moves toward the box material Z spread and moving rearward. As illustrated in FIG. 7B, one first flap Bf1 is pushed into the opening Bp by the surface 60*a* of the first member 60, and one first flap Bf1 is folded toward the inside of the opening Bp. Along with this operation, the first member 90 is driven, the other first flap Bf1 is pushed into the opening Bp by the first member 90, and the other first flap Bf1 is folded toward the inside of the opening Bp.

Figure 8:
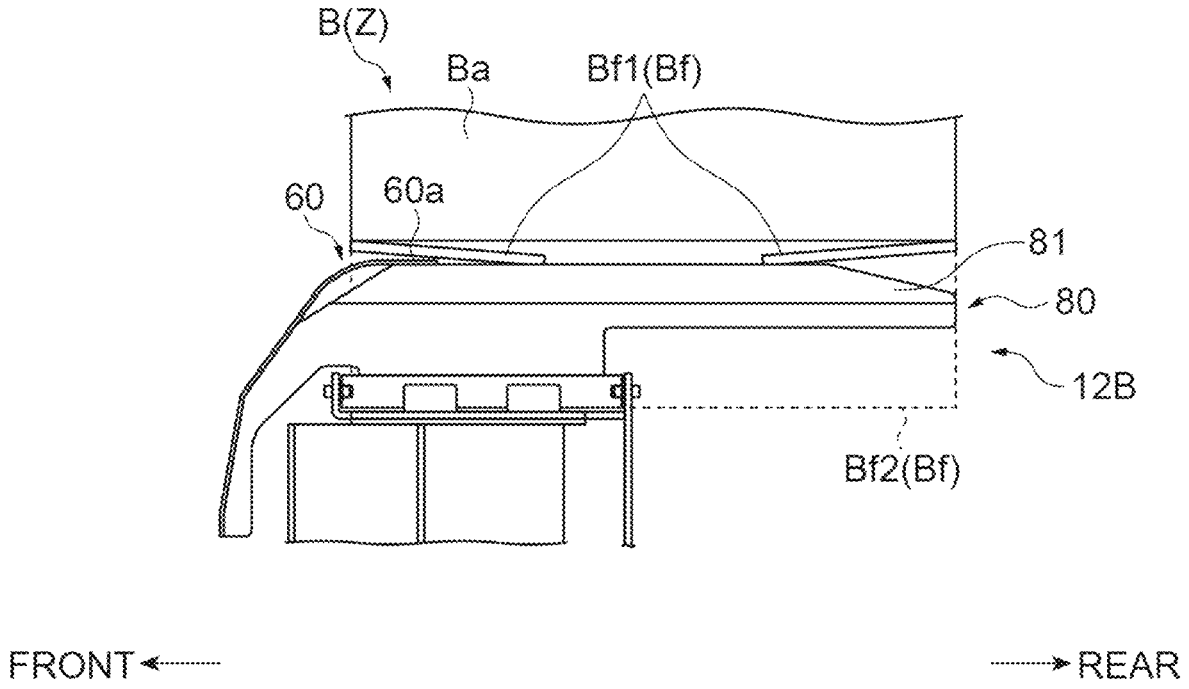
FIG. 8 is a side view subsequent to FIG. 7B.
Figure 9A:
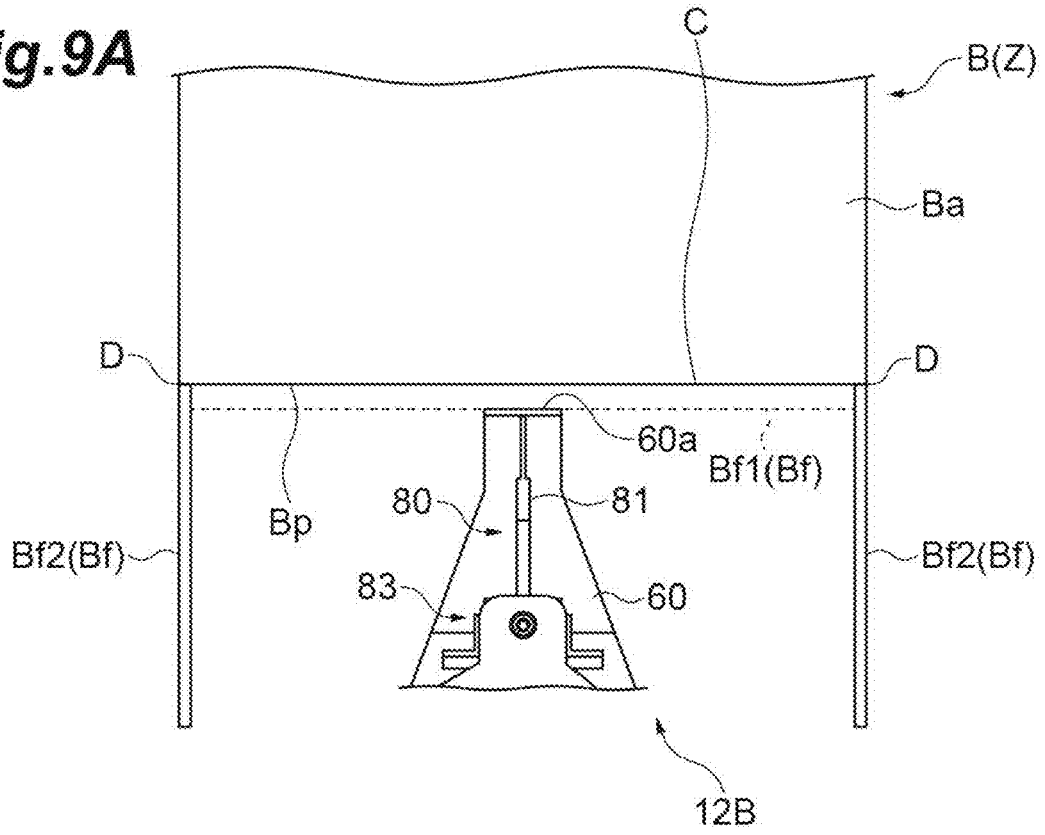
FIG. 9A is a rear view subsequent to FIG. 8.
Figure 9B:
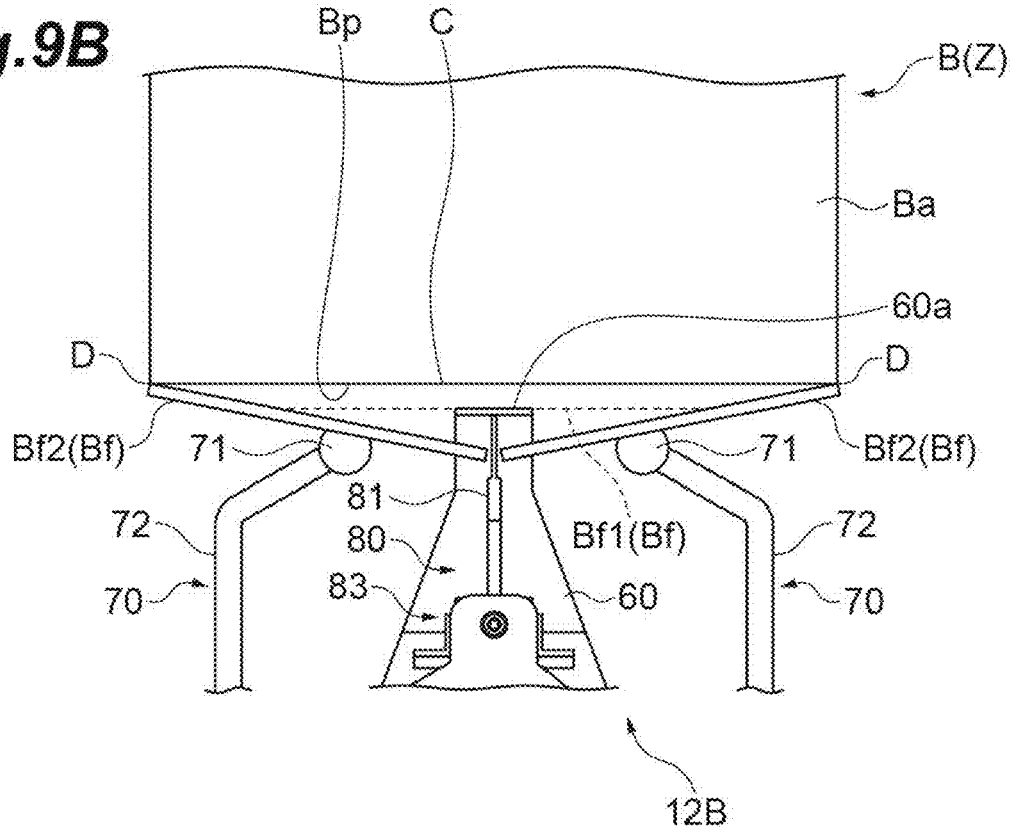
FIG. 9B is a rear view subsequent to FIG. 9A.

The flap folding device 12B continues to move, and as illustrated in FIG. 8, the elongated portion 81 of the holding member 80 presses and holds the pair of folded first flaps Bf1 (that is, supports the first flaps Bf1 not to drop). As illustrated in FIGS. 9A and 9B, in a state where the pair of first flaps Bf1 are held by the holding member 80 after the first members 60 and 90 fold the pair of first flaps Bf1, the second member 70 is driven, the pair of second flaps Bf2 is pushed into the opening Bp by the second member 70, and the pair of second flaps Bf2 is folded toward the inside of the opening Bp. In this case, in a state where the pair of folded first flaps Bf1 is pressed and held, the holding member 80 partitions a portion between the pair of second flaps Bf2 folded by the second member 70 such that the pair of second flaps Bf2 do not overlap each other.

Figure 10B:
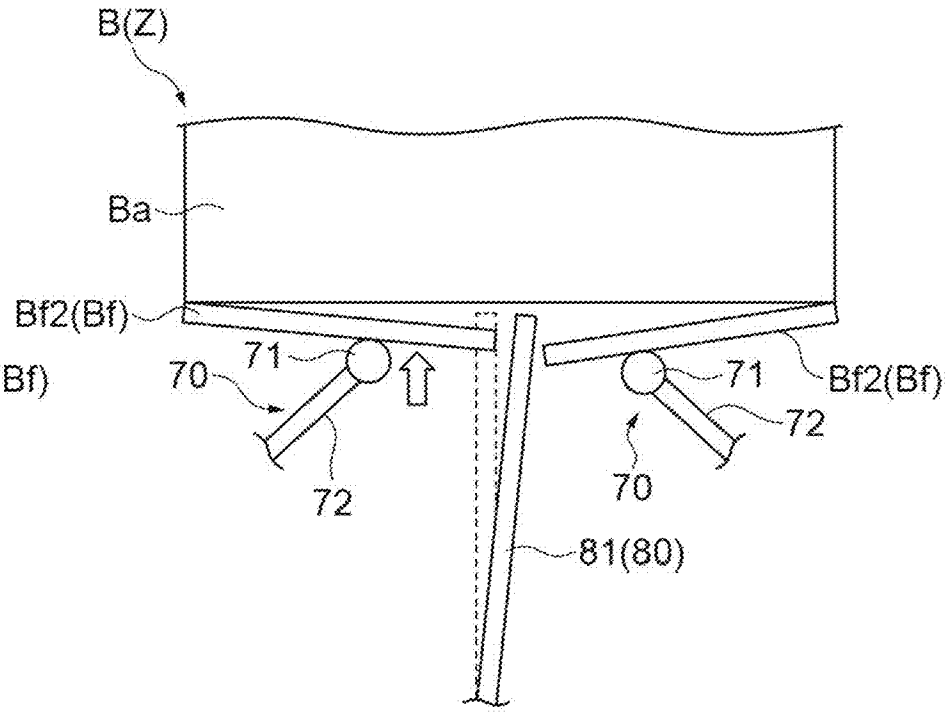
FIG. 10B is another schematic rear view for describing an operation of the flap folding device in FIG. 3.
Figure 10A:
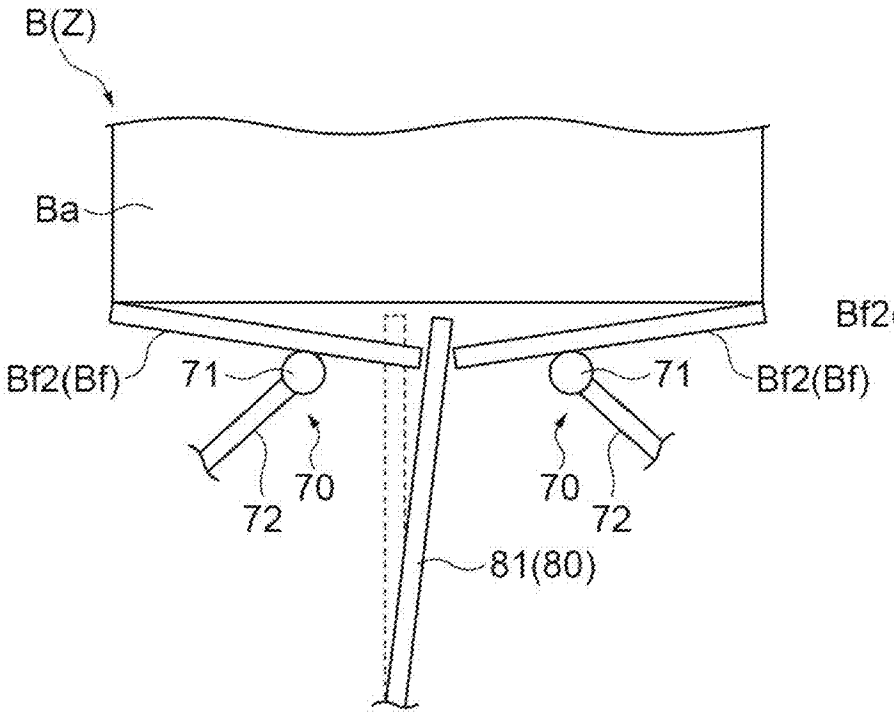
FIG. 10A is a schematic rear view for describing an operation of the flap folding device in FIG. 3.

Here, for example, as illustrated in FIG. 10A, the position of the holding member 80 or the height of the second member 70 may deviate, or as illustrated in FIG. 10B, dimensional accuracy of the cardboard box B may be poor. For this reason, the position of the holding member 80 with respect to the second flap Bf2 may deviate, thereby causing a possibility that both of these collide with each other. Even in this case, according to the flap folding device 12B, the holding member 80 swings around the shaft 84. In this manner, it is possible to avoid strong contact between the holding member 80 and the second flap Bf2. It is possible to avoid a possibility that the second flap Bf2 is bent or becomes transport resistance. It is possible to eliminate severity of quality of the cardboard box B or device assembly adjustment. The device newly has a flexible configuration, and it is easy to handle the device.

In the flap folding device 12B, when the opening has the substantially square shape, the flap Bf folded first is the first flap Bf1, and the flap Bf folded later is the second flap Bf2. In this way, in the present embodiment, even when the opening Bp of the spread box material Z has the substantially square shape, the present invention is applicable.

In the flap folding device 12B, the holding member 80 is configured to be swingable around the shaft 84. In this case, the holding member 80 can swing around the axis extending along the long side direction which is the direction along the long side D.

In the flap folding device 12B, in a state where the pair of folded first flaps Bf1 is pressed and held, the holding member 80 partitions a portion between the pair of second flaps Bf2 folded by the second member 70 such that the pair of second flaps Bf2 do not overlap each other. In this case, a possibility that the pair of second flaps Bf2 overlap each other can be avoided by the holding member 80.

In the flap folding device 12B, the first member 60 (portion of the first member) in the first member 60 and the first member 90 is provided integrally with the holding member 80. In this case, a device configuration can be simplified. The holding member 80 may be formed separately from the first member 60.

In the flap folding device 12B, the holding member 80 is swingable by at least 5° on each of one side and the other side in the rotation direction with respect to the reference position. In this case, the holding member 80 can effectively swing to avoid strong contact between the holding member 80 and the second flap Bf2. For example, when the swinging with respect to the reference position of the holding member 80 is smaller than 5° on one side and the other side in the rotation direction, the first flap Bf1 and the second flap Bf2 may be bent without avoiding the contact between the holding member 80 and the second flap Bf2, or the first flap Bf1 and the second flap Bf2 may deviate in the transport direction.

Even in the box manufacturing unit 12, the box sealing unit 32, and the box packaging device 1, the flap folding device 12B and 32A achieve an operational effect of avoiding the strong contact between the holding member 80 and the second flap Bf2.

Hitherto, the embodiments have been described. Meanwhile, the aspect of the present disclosure is not limited to the above-described embodiments.

In the above-described embodiment, 5° includes approximately 5°, and includes an error such as a measurement error. In the above-described embodiment, the box manufacturing unit 12 includes the flap folding device 12B, and the box sealing unit 32 includes the flap folding device 32A. Meanwhile, the box manufacturing unit 12 may include the flap folding device 12B without including the flap folding device 32A, or the box sealing unit 32 may include the flap folding device 32A without including the flap folding device 12B.

Each configuration in the above-described embodiments and the above-described modification examples is not limited to the above-described materials and shapes, and various materials and shapes are applicable. In addition, each configuration in the above-described embodiments and modification examples is optionally applicable to each configuration in other embodiments or modification examples.

What is claimed is:

1. A flap folding device that folds a pair of first flaps provided on a short side of an opening of a spread cardboard sheet and a pair of second flaps provided on a long side of the opening to form a bottom or a lid of a cardboard box, the device comprising:

a first member that folds the pair of first flaps toward an inside of the opening;

a second member that folds the pair of second flaps toward the inside of the opening; and a holding member including a rod-shaped or plate-shaped elongated portion extending along a long side direction of the opening, and pressing and holding the pair of folded first flaps by the elongated portion, wherein the second member folds the pair of second flaps in a state where the pair of first flaps are held by the holding member after the first member folds the pair of first flaps, and the holding member is attached to be swingable and the holding member is configured to be swingable around an axis extending along the long side direction.

2. The flap folding device according to claim 1, wherein when the opening has a substantially square shape, the flap folded first is the first flap, and the flap folded later is the second flap.

3. The flap folding device according to claim 1, wherein the holding member partitions a portion between the pair of second flaps folded by the second member such that the pair of second flaps do not overlap each other, in a state where the holding member presses and holds the pair of folded first flaps.

4. The flap folding device according to claim 1, wherein a portion of the first member is provided integrally with the holding member.

5. The flap folding device according to claim 1, wherein the holding member is swingable by at least 5° on each of one side and the other side in a rotation direction around the axis with respect to a reference position.

6. A box manufacturing device comprising:

a spreading unit that grips a cardboard sheet in a folded state and spreads the cardboard sheet into a rectangular tubular shape; and the flap folding device according to claim 1, which folds the pair of first flaps and the pair of second flaps of the cardboard sheet spread into the rectangular tubular shape by the spreading unit to form the bottom of the cardboard box.

7. A box packaging device comprising:

the box manufacturing device according to claim 6; and a box packaging unit that accommodates an article in a cardboard box manufactured by the box manufacturing device.

8. A box sealing device comprising:

the flap folding device according to claim 1, which folds the pair of first flaps and the pair of second flaps in the opening of the spread cardboard sheet having a bottom to form the lid of the cardboard box; and a tape attachment unit that attaches a tape to the lid to hold a state where the pair of second flaps is folded.

9. A box packaging device comprising:

the box sealing device according to claim 8; and a box packaging unit that accommodates an article in a cardboard box sealed by the box sealing device.

* * * * *